US007228094B2

(12) United States Patent
Jaskowiak et al.

(10) Patent No.: US 7,228,094 B2
(45) Date of Patent: Jun. 5, 2007

(54) NANO-SIZE POWDER COATINGS FOR DONOR MEMBERS

(75) Inventors: Timothy R. Jaskowiak, Webster, NY (US); Joy L. Longhenry, Webster, NY (US); Christopher D. Blair, Webster, NY (US)

(73) Assignee: Xerox Corporation, Stamford, CT (US)

( * ) Notice: Subject to any disclaimer, the term of this patent is extended or adjusted under 35 U.S.C. 154(b) by 200 days.

(21) Appl. No.: 11/063,908

(22) Filed: Feb. 22, 2005

(65) Prior Publication Data

US 2006/0188296 A1 Aug. 24, 2006

(51) Int. Cl.
*G03G 15/08* (2006.01)

(52) U.S. Cl. ..... 399/266; 399/279; 399/286

(58) Field of Classification Search ..... 399/266, 399/279, 286; 430/120; 428/195.1
See application file for complete search history.

(56) References Cited

U.S. PATENT DOCUMENTS

| | | | | |
|---|---|---|---|---|
| 5,008,167 | A | 4/1991 | Yu | 430/56 |
| 5,587,224 | A * | 12/1996 | Hsieh et al. | 399/286 |
| 5,714,248 | A | 2/1998 | Lewis | 428/325 |
| 6,300,027 | B1 | 10/2001 | Chambers et al. | 430/58.2 |
| 6,355,352 | B1 | 3/2002 | Chen et al. | 428/421 |
| 2003/0134209 | A1 | 7/2003 | Itami | 430/58.2 |

* cited by examiner

*Primary Examiner*—William J. Royer
(74) *Attorney, Agent, or Firm*—Annette L. Bade

(57) ABSTRACT

A donor member useful in ionographic or electrophotographic apparatuses and useful in hybrid scavengeless development units, having a substrate and an outer coating having a nano-size powder.

19 Claims, 3 Drawing Sheets

NANO-SIZE POWDER COATINGS FOR DONOR MEMBERS

CROSS REFERENCE TO RELATED APPLICATIONS

Attention is directed to commonly assigned U.S. Pat. No. 6,917,891 entitled, Process for Curing Marking Component with Nano-size Zinc Oxide Filler;" and U.S. Pat. No. 6,911,288 entitled, "Photosensitive Member Having Nano-size Filler;" the disclosures of each of these being hereby incorporated by reference in their entirety.

BACKGROUND

This application is directed to coatings for ionographic or electrophotographic, including digital and image on image, imaging and printing apparatuses and machines, and more particularly is directed to coatings for donor members such as those donor members including electrodes closely spaced therein to form a toner powder cloud in a development zone to develop a latent image. The application is directed, in embodiments, to suitable conductive and semiconductive overcoatings, for donor member or transport members like scavengeless or hybrid scavengeless development systems. In embodiments, the coatings comprise nano-size powders.

Generally, the process of electrophotographic printing includes charging a photoconductive member to a substantially uniform potential so as to sensitize the photoconductive surface thereof. The charged portion of the photoconductive surface is exposed to a light image of an original document being reproduced. This records an electrostatic latent image on the photoconductive surface. After the electrostatic latent image is recorded on the photoconductive surface, the electrostatic latent image is developed. Two component and single component developer materials are commonly used for development. Toner particles are attracted to the latent image forming a toner powder image on the photoconductive surface, the toner powder image is subsequently transferred to a copy sheet, and finally, the toner powder image is heated to permanently fuse the toner powder image to the copy sheet in image configuration.

One type of development system is a single component development system such as a scavengeless development system that uses a donor roll (donor member) for transporting charged toner (single component developer) to the development zone. At least one, and in embodiments, a plurality of electrode members, are closely spaced to the donor member in the development zone. An AC voltage is applied to the electrode members forming a toner cloud in the development zone. The electrostatic fields generated by the electrostatic latent image attract toner from the toner cloud to develop the electrostatic latent image.

Another type of development system is a two-component development system such as a hybrid scavengeless development system which employs a magnetic brush developer member (magnetic member) for transporting carrier having toner (two component developer) adhering triboelectrically thereto. A donor member is used in this configuration also to transport charged toner to the development zone. The donor member and magnetic member are electrically biased relative to one another. Toner is attracted to the donor member from the magnetic member. Electrically biased electrode members detach the toner from the donor member forming a toner powder cloud in the development zone, and the electrostatic latent image attracts the toner particles thereto.

In this way, the electrostatic latent image recorded on the photoconductive surface is developed with toner particles.

Coatings on the donor member can lead to various problems. For example, there can be a toner filming problem on the donor member. Filming consists of toner adhesion to the outside of the donor member, rendering it insulative, and reducing developability. Filming can dramatically reduce the donor member life. For example, donor member life can be reduced to from 20 million copies, to between 55,000 and 750,000 copies. Analysis of donor members has shown toner particles that have fused themselves into small pores and micro cracks on the surface of the ceramic coating. Once a single toner particle is fused into a pore, other toner particles migrate to the pore and attach themselves, which causes filming. It has been shown that less porous or non-porous films do not tend to have the toner filming problem.

U.S. Pat. No. 6,355,352 teaches use of a nano-size zinc oxide (Col. 8, line 62) in a layer of a marking member, wherein the nano-size filler has a particle size of from about 1 to about 250 (0.1 micrometers to 100 nanometers).

U.S. Pat. No. 6,300,027 teaches a photoreceptor having a hydrophobic silica having an average particle diameter of from about 1 to about 60 nanometers, preferably from about 7 to about 40 nanometers (col. 4, lines 54-57).

U.S. Patent Published Application 2003/134209 discloses at paragraph 207 use of alumina having a particle size of 45 nanometers in a protective layer of a charge transport layer of a photoreceptor.

U.S. Pat. No. 5,008,167 teaches a metal oxide having a particle size of 30 to 1,000 angstroms (3 to about 100 nanometers) in an imaging device (col. 14, lines 25-29).

U.S. Pat. No. 5,714,248 discloses an imaging member having a particle size of 10 to about 10,000 nanometers (col. 5, lines 57-62).

Therefore, there exists a need for a donor member coating which provides conductivity or resistivity within a desired range, and which has a coating that is less porous or non-porous. It is further desired that the donor member have wear-resistant properties so that the surface will not be readily abraded by adjacent surfaces. Further, it is desirable that the surface of the donor member be without anomalies such as pinholes, which may be created in the course of its manufacture. Pinholes created in the manufacturing process or caused by abrasions during use, can result in electrostatic "hot spots" and undesirable electrical arcing in the vicinity of such structural imperfections. It is an additional desired feature that the donor member have "uniform conductivity." Other physical properties of the donor member, such as the mechanical adhesion of toner particles, are also desired.

SUMMARY

Embodiments include a donor member comprising a substrate and having thereover a coating comprising a nano-size powder having a particle size of from about 25 to about 500 nanometers.

In addition, embodiments include an apparatus for developing a latent image recorded on a surface, comprising a) wire supports; b) a donor member spaced from the surface and being adapted to transport toner to a region opposed from the surface, wherein said donor member comprises a substrate and thereover a coating comprising a nano-size powder having a particle size of from about 25 to about 500 nanometers; and c) an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image.

Moreover, embodiments include an image forming apparatus for forming images on a recording medium comprising a) a charge-retentive surface to receive an electrostatic latent image thereon; b) a development component to apply toner to said charge-retentive surface to develop said electrostatic latent image to form a developed image on said charge retentive surface, said development component comprising a donor member comprising a substrate and having thereover a coating comprising a nano-size powder having a particle size of from about 25 to about 500 nanometers; and a transfer component to transfer the developed image from said charge retentive surface to a copy substrate.

DETAILED DESCRIPTION

This application relates to coatings for donor members in development units for electrostatographic, including digital and image on image, imaging and printing apparatuses, and for hybrid scavengeless development units.

Figure 1:
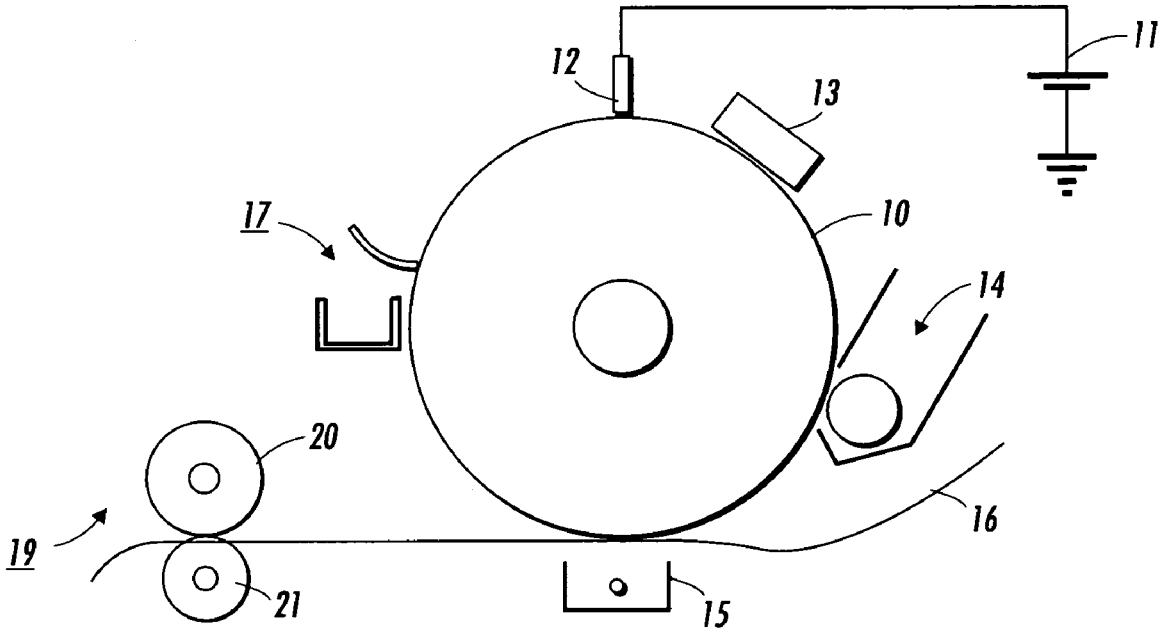
FIG. 1 is a schematic illustration of an electrostatographic printing machine.

Referring to FIG. 1, in a typical electrostatographic reproducing apparatus, a light image of an original to be copied is recorded in the form of an electrostatic latent image upon a photosensitive member and the electrostatic latent image is subsequently rendered visible by the application of electroscopic thermoplastic resin particles, which are commonly referred to as toner. Specifically, a photoreceptor 10 is charged on its surface by means of a charger 12 to which a voltage has been supplied from a power supply 11. The photoreceptor 10 is then imagewise exposed to light from an optical system or an image input apparatus 13, such as a laser and light emitting diode, to form an electrostatic latent image thereon. Generally, the electrostatic latent image is developed by bringing a developer mixture from a developer station (developer unit) 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the electrostatic latent image forming a toner powder image thereon. Alternatively, a liquid developer material may be employed, which includes a liquid carrier having toner particles dispersed therein.

After the toner particles have been deposited on the photoreceptor 10 in image configuration, they are transferred to a copy sheet 16 by a transfer means 15, which can be a pressure transfer means or electrostatic transfer means. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to a fusing station 19, depicted in FIG. 1, as a fuser member 20 and a pressure member 21 (although any other fusing components such as a fuser belt in contact with a pressure member, a fuser member in contact with a pressure belt, and the like, are suitable for use with the present apparatus), wherein the developed image is fused to the copy sheet 16 by passing the copy sheet 16 between the fusing and pressure members 20, 21, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

Figure 2:
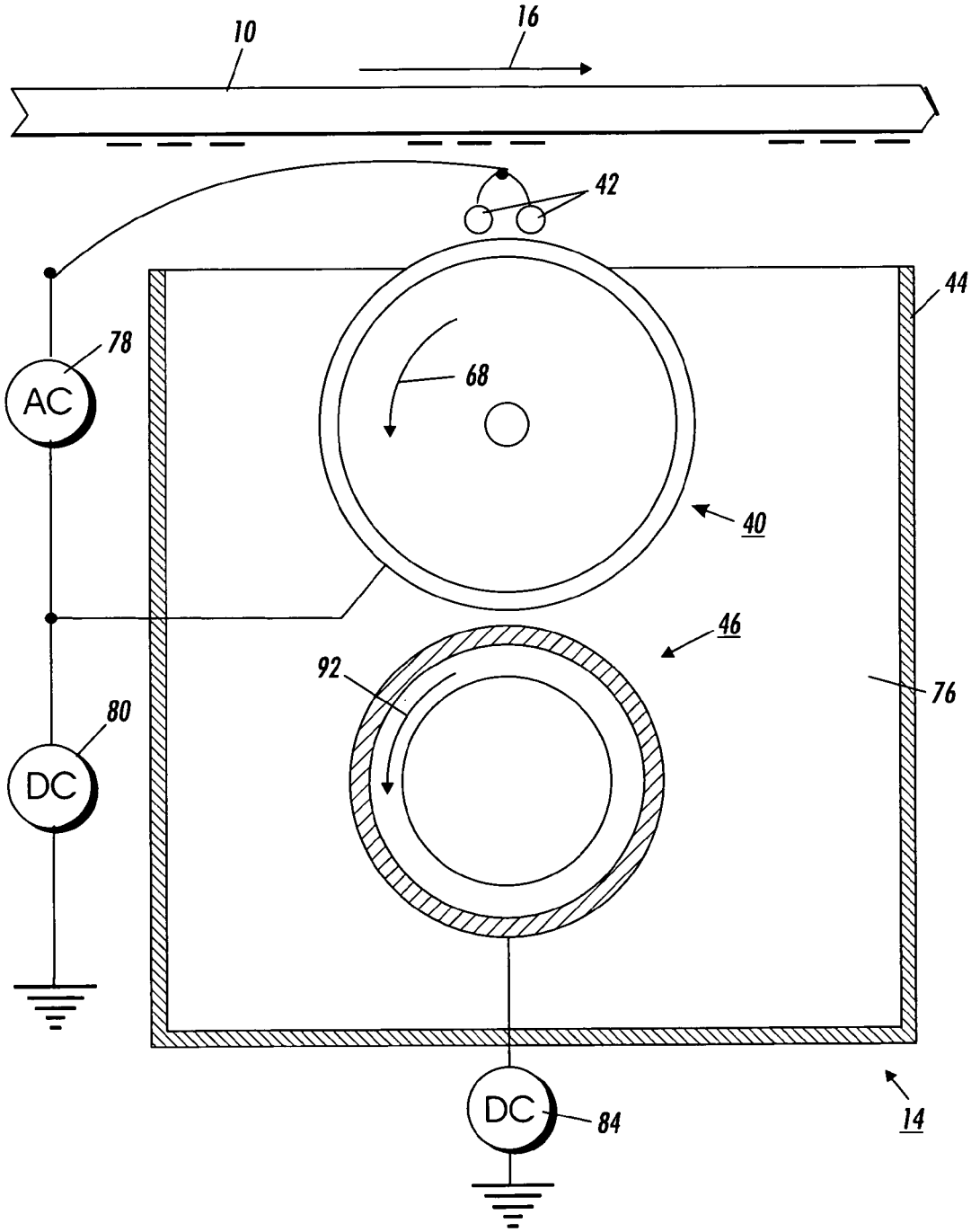
FIG. 2 is a schematic illustration of an embodiment of a development apparatus useful in an electrophotographic printing machine.

Referring now to FIG. 2, developer unit 14 develops the electrostatic latent image recorded on the photoreceptor 10. In embodiments, developer unit 14 includes donor roller 40 (donor member) and electrode member or members 42. Electrode members 42 are electrically biased relative to donor roller 40 to detach toner therefrom so as to form a toner powder cloud in the gap between the donor roller 40 and photoreceptor 10. The electrostatic latent image attracts toner particles from the toner powder cloud forming a toner powder image thereon. Donor roller 40 is mounted, at least partially, in the chamber of developer housing 44. A chamber 76 in developer housing 44 stores a supply of developer material, which is a two-component developer material of at least carrier granules having toner particles adhering triboelectrically thereto. A magnetic roller 46 disposed interior of the chamber 76 of developer housing 44 conveys the developer material to the donor roller 40. The magnetic roller 46 is electrically biased relative to the donor roller 40 so that the toner particles are attracted from the magnetic roller 46 to the donor roller 40.

The donor roller 40 can be rotated in either the 'with' or 'against' direction relative to the direction of motion of the photoreceptor 10. In FIG. 2, donor roller 40 is shown rotating in the direction of arrow 68. Similarly, the magnetic roller 46 can be rotated in either the 'with' or 'against' direction relative to the direction of motion of photoreceptor 10. In FIG. 2, magnetic roller 46 is shown rotating in the direction of arrow 92. Photoreceptor 10 moves in the direction of arrow 16.

The pair of electrode members 42 are shown extending in a direction substantially parallel to the longitudinal axis of the donor roller 40. The electrode members 42 are made from one or more thin (i.e., 50 to 100 μm in diameter) stainless steel or tungsten electrode members 42, which are closely spaced from the donor roller 40. The distance between the electrode members 42 and the donor roller 40 is from about 5 to about 35 μm, or from about 10 to about 25 μm or the thickness of the toner layer on the donor roll. The electrode members 42 are self-spaced from the donor roller 40 by the thickness of the toner on the donor roller 40.

As illustrated in FIG. 2, an alternating electrical bias is applied to the electrode members 42 by an AC voltage source 78. The applied AC voltage establishes an alternating electrostatic field between the electrode members 42 and the donor roller 40 is effective in detaching toner from the donor roller 40 and forming a toner cloud about the electrode members 42, the height of the cloud being such as not to be substantially in contact with the photoreceptor 10. The magnitude of the AC voltage is relatively low and is in the order of 200 to 500 volts peak at a frequency ranging from about 9 kHz to about 15 kHz. A DC bias supply 80, which applies approximately 300 volts to donor roller 40, establishes an electrostatic field between photoreceptor 10 and donor roller 40 for attracting the detached toner particles from the cloud surrounding the electrode members 42 to the electrostatic latent image recorded on the photoreceptor 10. At a spacing ranging from about 10 μm to about 40 μm between the electrode members 42 and donor roller 40, an applied voltage of 200 to 500 volts produces a relatively large electrostatic field without risk of air breakdown. A DC bias supply 84, which applies approximately 100 volts to magnetic roller 46, establishes an electrostatic field between magnetic roller 46 and donor roller 40 so that an electrostatic field is established between the donor roller 40 and the magnetic roller 46 which causes toner particles to be attracted from.

In an alternative embodiment, one component developer material consisting of toner without carrier may be used. In this configuration, the magnetic roller 46 is not present in the developer housing 44. This embodiment is described in more detail in U.S. Pat. No. 4,868,600, the disclosure of which is hereby incorporated by reference in its entirety.

Figure 3:
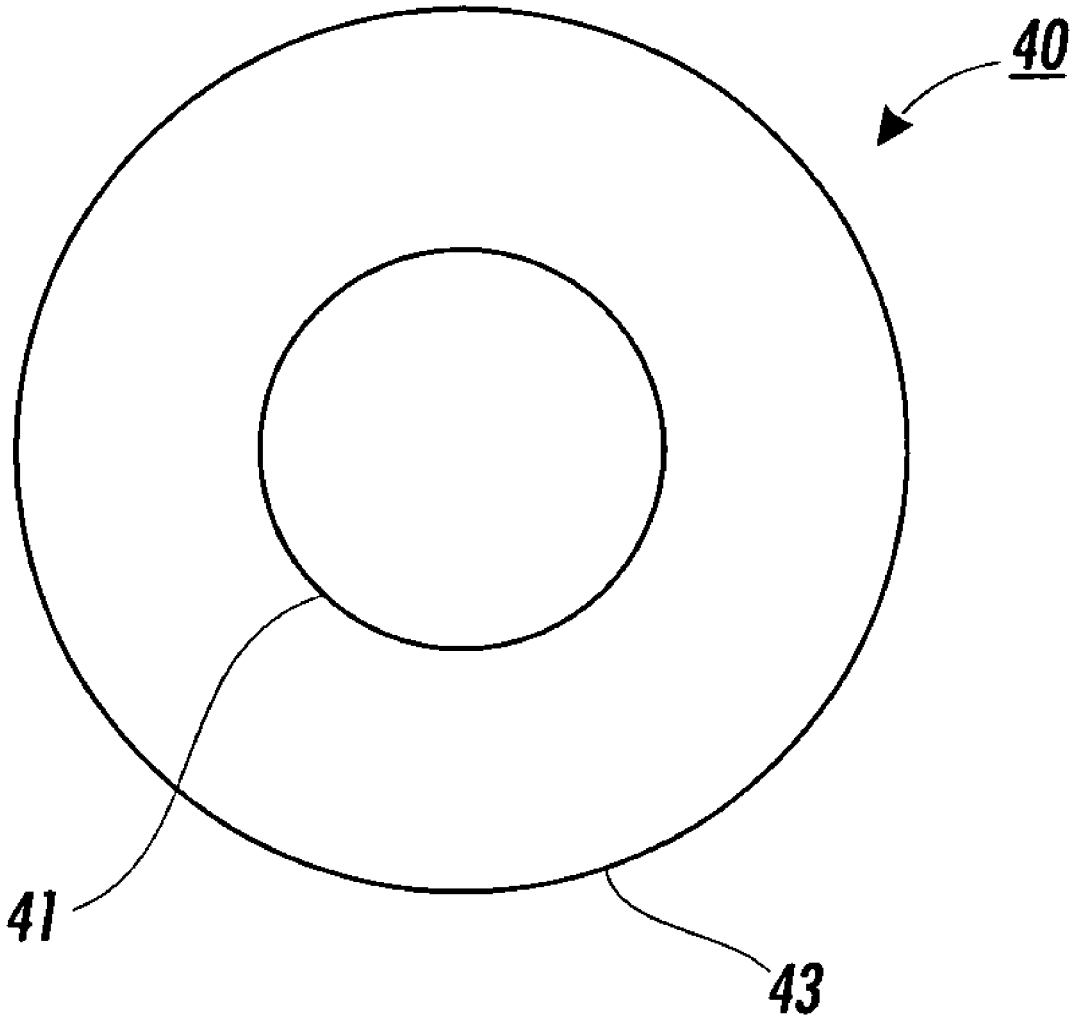
FIG. 3 is an enlarged illustration of an embodiment of a donor member showing an outer coating.

The donor roller 40 may be formed as depicted in FIGS. 2 and 3. As shown in FIG. 3, the donor roller 40 includes a substrate 41 which may comprise metal substrates such as, for example, copper, aluminum, nickel, and the like metals, plastics such as, for example, polyesters, polyimides, polyamides, polytetrafluoroethylene, and the like, glass and like substrates, which may be optionally coated with thin metal films, and a coating 43 including a nano-size powder coating.

Known donor member coatings comprise powders having a particle size of from about 5 to about 45 microns. Alternatively, in embodiments, the nano-size powder coating of the less-porous coating described herein, comprises a nano-size powder having a particle grain size of from about 25 to about 500 nanometers, or from about 25 to about 400 nanometers, or from about 25 to about 300 nanometers, or from about 25 to about 100 nanometers, or from about 25 to about 50 or 75 nanometers, with an agglomerated powder size of from about 1 to about 50 microns, or from about 1 to about 30 microns, or from about 1 to about 20 microns. The agglomerated powder size range allows for ease of plasma spraying.

Suitable nano-size powders include powders such as ceramics, metals, metal oxides, carbon blacks, polymers, and sol-gel particles, and mixtures thereof, as long as they are nano-size. Examples of suitable nano-size metal oxide powders include nano-size aluminum oxide, titanium dioxide, chromium oxide, zirconium oxide, zinc oxide, tin oxide, iron oxide, magnesium oxide, manganese oxide, nickel oxide, copper oxide, conductive antimony pentoxide and indium tin oxide, and the like, and mixtures thereof. Other examples of nano-size powders include high (HAF) or super (SAF) abrasion carbon black particles such as carbon black N110, N220, N330, N550 and N660, Regal 999, and conductive XC-72; thermally conducting carbon fillers; oxidized and reduced C 975U carbon black from Columbian and fluorinated carbon black such as ACCUFLUOR® or CARBOFLUOR®, and the like, and mixtures thereof. Suitable metal oxides include those made by the sol-gel process. Examples of sol-gel nano-size particles include hydrolyzed metal alkoxides or aryloxides such as tetraalkoxy orthosilicates, titanium isbutoxide, and the like, and mixtures thereof. Specific examples of suitable metal oxides include aluminum oxide and titanium dioxide, and the like, and mixtures thereof.

In embodiments, the nano-size powder is spherical in shape for better flowability.

Porosity is measured by Mercury Intrusion Porosimetry, and is from about 0.1 to about 10 or from about 1 to about 5, or from about 1 to about 2 percent by surface area of the donor member.

Providing an effective layer of the nano-size powder on the substrate may be accomplished for example, by known plasma spray coating of the nano-powder to form a layer coated member. Plasma spray coating technology is known and described in, for example, "Plasma-spray Coating," *Scientific American*, September 1988, pp. 112-117. This coating can be thermally sprayed, for example, by plasma spraying onto the substrate of the donor member so as to achieve the desired electrical properties, and to provide a thickness suitable for desired conductivity and breakdown voltage protection. However, even though plasma spraying is the desired thermal spraying process, other thermal spray processes may be used for spraying onto the substrate.

Plasma spraying generates a plasma by passing an inert gas through a high voltage electric arc. The ionized gas is forced through a nozzle where powder is introduced into the plasma stream. The powder melts and is projected at high velocities onto a substrate. Depending on the particular substrate used it may be necessary to cool the samples with air jets during the plasma spray process. The surface smoothness of the coating can be quantitatively characterized by known surface roughness measurement and characterization equipment.

In embodiments of the coating, the surface of the coating can have a maximum waviness (Wt) of less than about 2 micrometers and a surface smoothness or arithmetical mean roughness Ra of less than about 1.5 micrometers after completion of all finishing operations on the coating. In other embodiments, the surface of the coating can be even smoother and can have a maximum waviness Wt of less than about 1 micrometer and a surface smoothness or arithmetical mean roughness Ra of less than about 0.3 micrometers, after all finishing operations have been performed on the coating.

In addition, a nano-powder coating provides an advantage that it can be more easily prepared to the desired surface finish characteristics than known coating materials used for donor members, such as alumina and alumina-titania compositions of micron size. That is, nano-coatings can be machined, such as by grinding, to a smoother, or lower roughness finish than known coating materials such as those containing micron size powders.

The nano-size fillers provide antistatic properties to the outer layer in a highly conductive range of from about $10^4$ to about $10^{12}$ ohm-cm or from about $10^8$ to about $10^{10}$ ohm-cm. The coating layer is semi-conductive or semi-insulating and is capable of holding a charge for a period of time without dissipation or leakage. In embodiments, the resistivity of the coated donor member can be, for example, from about $10^3$ to about $10^{10}$ ohm-cm, or from about $10^7$ to about $10^{10}$ ohm-cm.

The nano-size powder can be coated onto the donor member to a thickness of from about 50 to about 500 microns, or from about 100 to about 300 microns.

In embodiments, an intermediate layer can be positioned between the substrate and the nano-size powder coating. In embodiments, examples of suitable intermediate layers include a 1:1 by volume mixture of chrome aluminum yttrium cobalt powder and titanium dioxide commercially available from Sulzer Metco as 102. The bond coat provides enhanced adhesion of a ceramic layer coating to the donor member.

Protective outer layers may be used if desired. The protective outer layer may comprise waxes, polymeric resins, metal oxides, mixed metal oxides, hydrophobic metal oxides or mixed hydrophobic metal oxides, and mixtures thereof. A protective overcoat prevents or can compensate for, for example, wear and moisture penetration, and can be used to further adjust or fine tune the physical properties and performance characteristics of the donor member surface, such as conductivity, surface tension, friction, and the like surface aspects. Protective sealer or overcoating layers include, for example, carnuba wax, or a more durable and thermally robust substance such as the aforementioned hydrophobic metal oxides, such as titanates, silicates, silanes, and the like compounds, and mixtures thereof. The overcoating layer can be applied after optional machining of the ceramic surface layer.

In addition to protective overcoats, a heat-shrinkable polymeric sleeve can be inserted over the donor member. This sleeve may consist of polytetrafluoroethylene (PTFE) and/or ethylenetetrafluoroethylene (ETFE). This serves to prevent filming of the donor member by toner.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Member Substrate

A suitable member substrate or core can be gritblasted to a suitable surface finish.

Example 2

Preparation of Bond Coat

It is possible to use a bond coat to enhance adhesion of the coating to the member or sleeve. A chrome aluminum yttrium cobalt powder, commercially available from Praxair as CO-106-1, can be plasma sprayed over a grit blasted steel substrate according to manufacturer recommended spray parameters accompanying the powder. This would be followed by an optional plasma spray midcoat consisting of a 1:1 by volume mixture of chrome aluminum yttrium cobalt powder and titanium dioxide commercially available from Sulzer Metco as 102. Other commercially available bond coats are believed to be useful for either or both bond or mid-coating.

Example 3

Nano Plasma-Sprayed Coating

Plasma spray coating of a nano alumina-titania layer can be accomplished with Praxair Thermal Spray Equipment using a SG 100 gun. The powder may be obtained from Inframat Advanced Materials LLC, Farmington, Conn. It may then be heated to approximately 120° C. for at least 24 hours prior to spraying. The coating may be sprayed to between 250 and 400 microns thickness. Alternative plasma coating approaches can use other equipment, gases, and/or powder particle sizes, wherein parameters are adjusted accordingly to achieve the same or similar result. For example, High Velocity Oxy Fuel (HVOF) or other thermal spray processes are believed to be adaptable and satisfactory to achieving comparable and equivalent coating results.

Example 4

Grinding of Nano Outer Coating

The coating can be ground to between 150 and 200 microns thickness to achieve a desired diameter and surface finish.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. A donor member comprising a substrate and having thereover a coating comprising a nano-size powder having a particle size of from about 25 to about 500 nanometers.

2. A donor member in accordance with claim 1, wherein said particle size is from about 25 to about 400 nanometers.

3. A donor member in accordance with claim 2, wherein said particle size is from about 25 to about 300 nanometers.

4. A donor member in accordance with claim 1, wherein said nano-size powder comprises a material selected from the group consisting of metals, ceramics, and metal oxides.

5. A donor member in accordance with claim 4, wherein said nano-size powder comprises a metal oxide.

6. A donor member in accordance with claim 5, wherein said metal oxide is selected from the group consisting of aluminum oxide, titanium dioxide, and mixtures thereof.

7. A donor member in accordance with claim 6, wherein said metal oxide is selected from the group consisting of aluminum oxide and titanium dioxide.

8. A donor member in accordance with claim 4, wherein said nano-size powder is spherical in shape.

9. A donor member in accordance with claim 1, wherein said nano-size powder has a porosity of from about 0.1 to about 10 percent by surface area of the donor member.

10. A donor member in accordance with claim 9, wherein said porosity is from about 1 to about 5 percent by surface area of the donor member.

11. A donor member in accordance with claim 1, wherein said coating is of a thickness of from about 50 to about 500 microns.

12. A donor member in accordance with claim 11, wherein said coating is of a thickness of from about 100 to about 300 microns.

13. A donor member in accordance with claim 12, wherein said substrate comprises polytetrafluoroethylene.

14. A donor member in accordance with claim 1, wherein said substrate is in the form of a cylindrical roll.

15. A donor member in accordance with claim 1, wherein said substrate comprises a polymer selected from the group consisting of polyesters, polytetrafluoroethylene, polyimides, polyamides, and mixtures thereof.

16. A donor member in accordance with claim 1, wherein said coating has a conductivity of from about $10^3$ to about $10^{10}$ ohm-cm.

17. A donor member in accordance with claim 16, wherein said conductivity is from about from about $10^7$ to about $10^{10}$ ohm-cm.

18. An apparatus for developing a latent image recorded on a surface, comprising:

a) wire supports;

b) a donor member spaced from the surface and being adapted to transport toner to a region opposed from the surface, wherein said donor member comprises a substrate and thereover a coating comprising a nano-size powder having a particle size of from about 25 to about 500 nanometers; and c) an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image.

19. An image forming apparatus for forming images on a recording medium comprising:

a) a charge-retentive surface to receive an electrostatic latent image thereon;

b) a development component to apply toner to said charge-retentive surface to develop said electrostatic latent image to form a developed image on said charge retentive surface, said development component comprising a donor member comprising a substrate and having thereover a coating comprising a nano-size powder having a particle size of from about 25 to about 500 nanometers; and a transfer component to transfer the developed image from said charge retentive surface to a copy substrate.

* * * * *